US008316770B1

(12) United States Patent
Fisher et al.

(10) Patent No.: US 8,316,770 B1
(45) Date of Patent: Nov. 27, 2012

(54) MUNITION HAVING PAYLOAD OF HIGH-DENSITY SPHEROIDS

(75) Inventors: Patrick Fisher, Newton, NJ (US); Meghan Abraham, Elizabethtown, PA (US); Bhuvanesh Thoguluva, Lake Hopatcong, NJ (US); Keith Martin, Hellertown, PA (US); Robin Zeto, Parkville, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 365 days.

(21) Appl. No.: 12/366,976

(22) Filed: Feb. 6, 2009

Related U.S. Application Data

(60) Provisional application No. 61/060,148, filed on Jun. 10, 2008.

(51) Int. Cl.
*F42B 12/64* (2006.01)
*F42B 12/58* (2006.01)

(52) U.S. Cl. ..... 102/454; 102/449; 102/438; 102/506; 102/517; 102/703

(58) Field of Classification Search ..... 102/448, 102/449, 454, 506, 438, 439, 517, 520, 703
See application file for complete search history.

(56) References Cited

U.S. PATENT DOCUMENTS

| | | | | |
|---|---|---|---|---|
| 1,388,503 | A * | 8/1921 | Ayer | 102/454 |
| 1,388,508 | A * | 8/1921 | Brilhart | 105/4.4 |
| 2,767,656 | A * | 10/1956 | Zeamer | 102/438 |
| 3,074,344 | A * | 1/1963 | Devaux | 102/454 |
| 3,981,242 | A * | 9/1976 | Shurtleff | 102/454 |
| 6,988,450 | B1 * | 1/2006 | Georgantzis et al. | 102/401 |
| 7,418,906 | B2 * | 9/2008 | Brislin et al. | 102/494 |

* cited by examiner

*Primary Examiner* — James Bergin
(74) *Attorney, Agent, or Firm* — Michael C. Sachs

(57) ABSTRACT

A munition round includes a cartridge case; a canister disposed at a forward end of the cartridge case, the canister including a piston movable in the canister; a plurality of high-density spheroids having a diameter in a range of about 0.25 inches to about 0.5 inches; a rear container disposed in the canister adjacent the piston, and fully loaded with the high-density spheroids; a front container disposed in the canister and partially loaded with the high-density spheroids, a remaining volume of the front container occupied by a spacer disc disposed atop the high-density spheroids; and a cap that closes a forward end of the canister.

13 Claims, 2 Drawing Sheets

MUNITION HAVING PAYLOAD OF HIGH-DENSITY SPHEROIDS

CROSS-REFERENCE TO RELATED APPLICATIONS

This application claims the benefit under 35 USC 119(e) of U.S. provisional patent application No. 61/060,148, filed Jun. 10, 2008, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to anti-personnel ammunition.

The Multi-Role, Anti Armor Weapon System (MAAWS) Area Deterrent Munition (ADM) 401 is an 84 mm shoulder-fired munition (round) for use with the recoilless M3 (Carl-Gustaf) weapon system. The MAAWS ADM 401 was developed by SAAB Bofors Dynamics. The MAAWS ADM 401 is an anti-personnel round containing a payload of flechettes.

The known ADM 401 round includes a canister filled with flechettes. The flechettes have a limited range and are typically used at engagement distances of 50-100 meters. It has been observed that a large number of the flechettes may become embedded in the separation plate upon launch of the round. The separation plate full of flechettes then flies downrange and may overshoot the target completely. Because the separation plate may be embedded with up to ⅓ of the total number of flechettes per round; the embedded flechettes significantly limit the potential of the round. Thus, there is a need to increase the engagement distance and lethality of the ADM 401 anti-personnel round.

SUMMARY OF THE INVENTION

It is an object of the invention to provide a munition with increased lethality, compared to the MAAWS ADM 401 munition.

It is another object of the invention to provide a payload that may be used with the canister and cartridge case of the MAAWS ADM 401 munition.

One aspect of the invention is a munition round comprising a cartridge case and a canister disposed at a forward end of the cartridge case. The canister may include a piston movable in the canister. The munition round may further comprise a plurality of high-density spheroids having a diameter in a range of about 0.25 inches to about 0.5 inches; a rear container disposed in the canister adjacent the piston and fully loaded with the high-density spheroids; and a front container disposed in the canister and partially loaded with the high-density spheroids. The remaining volume of the front container may be occupied by a spacer disc disposed atop the high-density spheroids. A cap may close a forward end of the canister.

Another aspect of the invention is a method of loading a canister comprising providing a rear container, a front container, a separation plate, and a spacer disc; weighing the rear container, the front container, the separation plate, and the spacer disc; and determining a weight of spheroids to be loaded in the canister by subtracting a combined weight of the rear container, the front container, the separation plate, and the spacer disc, from a fixed weight.

A further aspect of the invention is a payload comprising a canister, the canister including a piston movable therein; a plurality of high-density spheroids having a diameter in a range of about 0.25 inches to about 0.5 inches; a rear container disposed in the canister adjacent the piston, and fully loaded with the high-density spheroids; a front container disposed in the canister and partially loaded with the high-density spheroids, a remaining volume of the front container occupied by a spacer disc disposed atop the high-density spheroids; and a cap that closes a forward end of the canister.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A munition or round intended for area denial may spread approximately 300 generally spherical objects (spheroids) against the target area. The spheroids may be disposed in a canister and arranged in two layers above a moving plunger. The moving plunger may expel the spheroids out of the canister during flight. A cushioning material, for example, felt, may be disposed forward of the spheroids. The cushioning material may occupy the space between the spheroids and the canister. The round may closely match the flight trajectory of the MAAWS ADM 401 round.

The novel round may have increased kinetic energy, compared to the ADM 401 round. The increased kinetic energy may be due to the high-density spheroids that do not become imbedded in the separation plate upon launch. The increased kinetic energy may result in a greater range for the payload, which may increase the maximum engagement distance. The increase in maximum engagement distance may allow soldiers to fire the round at increased ranges, without unnecessarily putting themselves in danger. That is, the soldiers need not wait until the target is within 50-100 meters to fire.

Comparative testing of the flechette and spheroid payloads showed that, at 100 meters, the flechettes had a velocity of 125 meter/second and the spheroids had a velocity of 163 meter/second. Although the total number of spheroids per round was approximately ⅓ of the total number of flechettes per round, there were a similar number of penetrations for both spheroid payloads and flechette payloads. About half of all total spheroid hits resulted in a penetration, while about one third of all flechette hits resulted in a penetration. The spheroid payload has a longer range and more penetrations per hit than the flechette payload.

Previous attempts to substitute spheroids for the flechettes in the ADM 401 round were not successful. Numerous configurations, materials, and sizes of spheroids, as well as cushioning material, have been attempted. The spheroid payload must use the known ADM 401 round propulsion system. Therefore, the weight and center of gravity of the spheroid payload round must be similar to the weight and center of gravity of the flechette payload round. Because high-density spheroids are denser than flechettes, there is excess space in the canister when using spheroids as the payload. Previous attempts often failed due to, the placement of the filler material.

Figure 1:
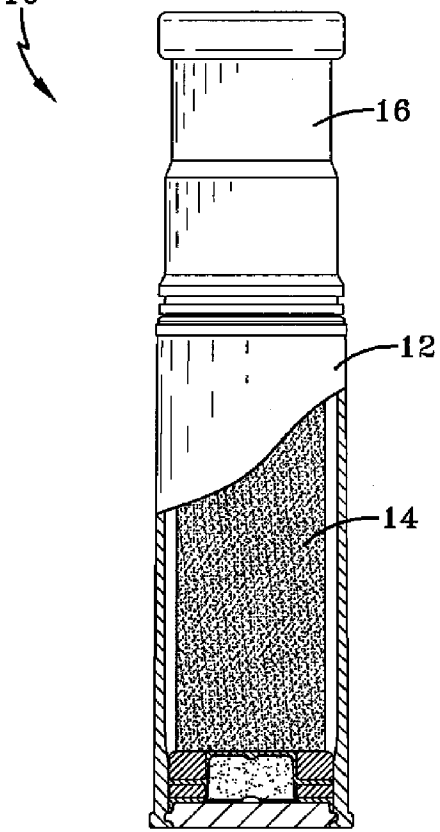
FIG. 1 is a schematic side view, partially cut-away, of one embodiment of a round in accordance with the invention.

FIG. 1 is a schematic side view, partially cut-away, of one embodiment of a round 10 in accordance with the invention. Round 10 may include a cartridge case 12, propellant 14 disposed in the cartridge case 12, and a canister 16 disposed atop the cartridge case 12. The cartridge case 12 and propellant 14 are components of the known ADM 401 round. The canister 16, however, contains high-density spheroids, rather than flechettes.

Figure 2:
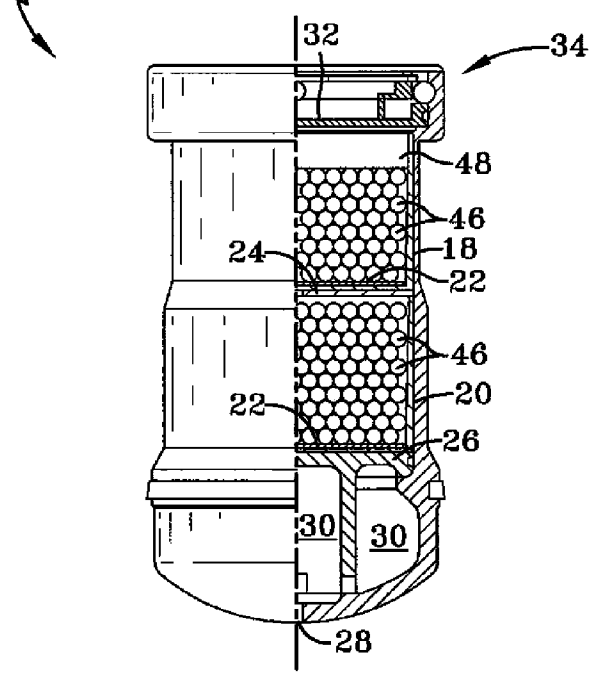
FIG. 2 is a side view, partially in section, of the canister of FIG. 1.

FIG. 2 is a side view, partially in section, of the canister 16 of FIG. 1. Canister 16 may include a piston 26 that is movable in the canister 16 and a gas opening 28 that communicates with the interior of the cartridge case 12 (FIG. 1). When the round 10 is fired, propellant gases from the cartridge case 12 enter areas 30 in canister 16 via opening 28. When the canister 16 leaves the gun tube, the propellant gases in areas 30 force the piston 26 forward.

Disposed adjacent piston 26 is a rear container 20, and disposed adjacent rear container 20 is a front container 18. A cover 32 closes the forward end 34 of canister 16. The front and rear containers 18, 20 may be made of, for example, a plastic. Canister 16 and cover 32 may be made of, for example, aluminum.

Figure 3:
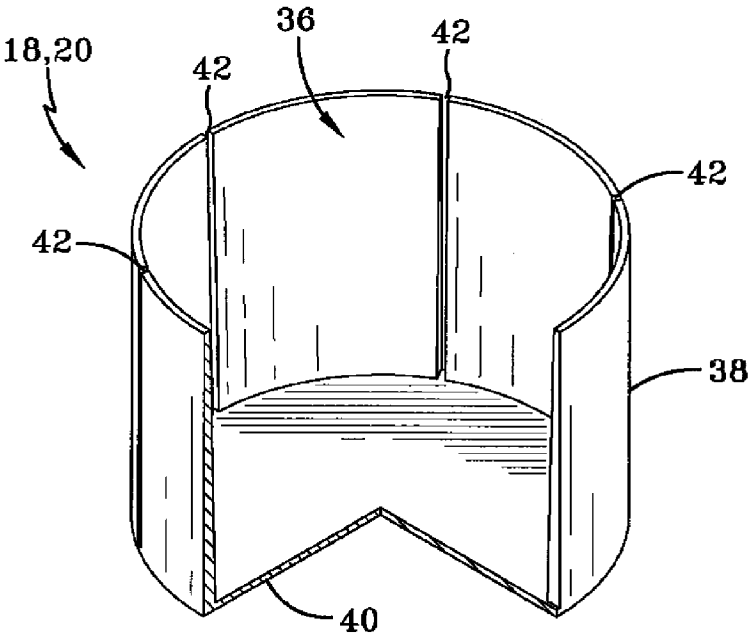
FIG. 3 is a view, partially in section, of a container without any payload therein.

FIG. 3 is a view, partially in section, of a container 18, 20 without any payload therein. Container 18, 20 is generally cup-shaped with an open top 36, a side wall 38, and a bottom 40. Side wall 38 may increase in thickness from open top 36 toward bottom 40. A plurality of circumferentially spaced longitudinal slits 42 may be formed in side wall 38 so that containers 18, 20 will open up upon exiting canister 16. That is, the air resistance will force the sections of the side wall 38 between slits 42 to fold rearward as the container 18, 20 moves through the air. The rearward folding of the sections of the side wall 38 helps disperse the spheroid payload.

Figure 4:
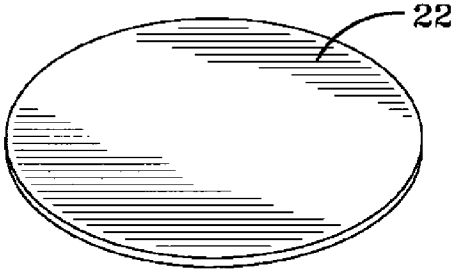
FIG. 4 is a top view of a support disc for the container of FIG. 3

FIG. 4 is a top view of a solid support disc 22 that may be placed inside container 18, 20 atop the bottom 40. Support disc 22 may be made of, for example, aluminum. Support disc 22 provides additional strength to bottom 40 of container 18, 20.

The payload in canister 16 is a plurality of high-density spheroids 46 (FIG. 2). High-density means a density in the range of metal densities, for example, about 3000 to about 20,000 kg/m$^3$. Preferably, the density of the spheroids 46 is in the range of stainless steel, for example, about 6500 to about 9000 kg/m$^3$, and more preferably, the density of the spheroids 46 is about 7400 to about 8000 kg/m$^3$. Spheroids 46 have a diameter in a range of about 0.25 inches to about 0.5 inches. Preferably, the diameter of the spheroids is about 0.375 inches.

Rear container 20 is fully loaded with the high-density spheroids 46, that is, the spheroids 46 occupy the space from the bottom 40 (atop the support disc 22) to the open top 36 (FIG. 3). Front container 18 is partially loaded with the spheroids 46, starting at the bottom 40 (atop the support disc 22) of the front container 18 and ending short of the open top 36. The remaining space in front container 18 is occupied by a spacer disc 48. Spacer disc 48 may be made of, for example, felt. Preferably, the felt material complies with ASTM D2475-01 F7.

Figure 5:
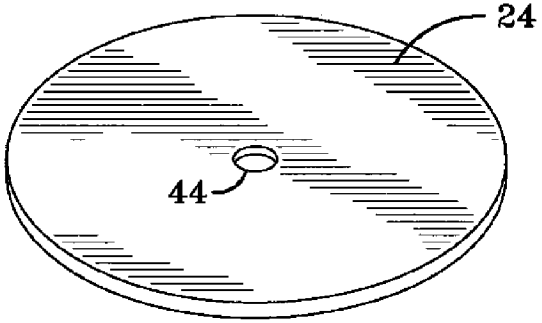
FIG. 5 is a top view of a separation plate.

The front and rear containers 18, 20 may be separated by a separation plate 24 (FIGS. 2 and 5). Separation plate 24 may include a generally centrally located opening 44 therein to allow pressure equalization between the areas on opposite sides of the separation plate 24. Separation plate 24 may be made of, for example, aluminum.

The quantity of high-density spheroids 46 required in a round 10 may be determined by first weighing the front and rear containers 18, 20 (each container 18, 20 including a support disc 22), the spacer disc 48, and the separation plate 24. Then, enough high-density spheroids 46 are added such that the combined weight of the front and rear containers 18, 20 (each container 18, 20 including a support disc 22), the spacer disc 48, the separation plate 24, and the plurality of high-density spheroids 46 is preferably about 1.2 kilograms, plus or minus about 10 grams.

If the spheroids 46 are made of stainless steel and have a diameter of about 0.375 inches, the number of spheroids 46 is about 300. An important criterion is the combined weight of the components. The combined weight is preferably about 1.2 kilograms, plus or minus about 10 grams. As discussed earlier, the rear container 20 is fully loaded with the spheroids 46, and then the front container 18 is loaded with the remaining spheroids 46.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A munition round, comprising:

a cartridge case;

a canister disposed at a forward end of the cartridge case, the canister including a piston movable in the canister upon flight initiation;

a plurality of high-density spheroids having a diameter in a range of about 0.25 inches to about 0.5 inches being released from the container at a predetermined range;

a rear container disposed in the canister adjacent the piston, and fully loaded with the high-density spheroids;

a front container disposed in the canister and partially loaded with the high-density spheroids, a remaining volume of the front container occupied by a spacer disc disposed atop the high-density spheroids;

a separation plate disposed between the front container and rear container, and a cap that closes a forward end of the canister.

2. The round of claim 1, wherein the spheroids have a diameter of about 0.375 inches.

3. The round of claim 1, wherein the cartridge case comprises an 84 mm cartridge case.

4. The round of claim 1, wherein a density of the high-density spheroids is in a range of about 7400 to about 8000 kg/m$^3$.

5. The round of claim 4, wherein the high-density spheroids comprise stainless steel.

6. The round of claim 1, wherein the front and rear containers each include a side wall that increases in thickness toward a bottom of each container.

7. The round of claim 6, wherein the side walls include longitudinal slits formed therein.

8. The round of claim 1, wherein the separation plate includes a gas opening therein.

9. The round of claim 1, wherein a number of high-density spheroids is in a range of about 250 to about 350.

10. The round of claim 9, wherein the number of high-density spheroids is about 300.

11. A payload, comprising:

a canister, the canister including a piston movable therein;

a plurality of high-density spheroids having a diameter in a range of about 0.25 inches to about 0.5 inches;

a rear container disposed in the canister adjacent the piston, and fully loaded with the high-density spheroids;

a front container disposed in the canister and partially loaded with the high-density spheroids, a separation plate disposed between the rear and front containers and a remaining volume of the front container occupied by a spacer disc disposed atop the high-density spheroids; and a cap that closes a forward end of the canister.

12. The payload of claim 11, wherein a density of the high-density spheroids is in a range of about 7400 to about 8000 $kg/m^3$.

13. The payload of claim 11, wherein the front and rear containers each include a side wall that increases in thickness toward a bottom of each container.

* * * * *